US009428376B2

(12) United States Patent
McInulty

(10) Patent No.: US 9,428,376 B2
(45) Date of Patent: Aug. 30, 2016

(54) STIRRUP

(71) Applicant: Jason McInulty, Kent (GB)

(72) Inventor: Jason McInulty, Kent (GB)

( * ) Notice: Subject to any disclaimer, the term of this patent is extended or adjusted under 35 U.S.C. 154(b) by 0 days.

(21) Appl. No.: 14/539,596

(22) Filed: Nov. 12, 2014

(65) Prior Publication Data

US 2015/0128538 A1 May 14, 2015

(30) Foreign Application Priority Data

Nov. 13, 2013 (GB) ..... 1320054.8

(51) Int. Cl.
*B68C 3/02* (2006.01)
*B68C 3/00* (2006.01)

(52) U.S. Cl.
CPC . *B68C 3/00* (2013.01); *B68C 3/02* (2013.01); *B68C 2003/0058* (2013.01)

(58) Field of Classification Search
CPC . B68C 3/00; B68C 3/0016; B68C 2003/005; B68C 2003/0058; B68C 2003/0075; B68C 2003/0083; B68C 3/02
USPC ..... 54/47–49, 49.5
IPC ..... B68C 3/00, 3/02
See application file for complete search history.

(56) References Cited

U.S. PATENT DOCUMENTS 16,032 A * 11/1856 Trussell ..... B68C 3/02 236/1 R
211,668 A * 1/1879 Pulliam ..... B68C 3/0016 54/49
756,270 A * 4/1904 McVey ..... B68C 3/00 54/47
841,793 A * 1/1907 Levy ..... B68C 3/0016 54/49
1,062,327 A * 5/1913 Erbe ..... B68C 3/02 54/49
1,098,662 A * 6/1914 Chappell ..... B68C 3/02 54/49
1,111,731 A * 9/1914 Boyd et al. ..... B68C 3/02 54/49
1,276,819 A * 8/1918 Sklar ..... B68C 3/02 54/49
2,772,532 A * 12/1956 Tann ..... B68C 3/02 54/49
3,910,015 A * 10/1975 Ebejer ..... B68C 3/02 54/49
5,809,754 A * 9/1998 Schulte ..... B68C 3/00 54/47
5,826,413 A * 10/1998 Bostock ..... B68C 3/02 54/49
2007/0157584 A1* 7/2007 Bostock ..... B68C 3/02 54/49
2010/0162670 A1* 7/2010 Bostock ..... B68C 3/02 54/49
2016/0115012 A1* 4/2016 Dejong ..... B68C 3/0016 54/47

* cited by examiner

*Primary Examiner* — Lisa Tsang

(74) *Attorney, Agent, or Firm* — Barnes & Thornburg LLP

(57) ABSTRACT

A safety stirrup for riding an animal comprising: a first portion adapted to rest against an animal to be ridden; and a second portion adapted to support a rider's foot. The safety stirrup further comprises a biasing member adapted to bias the safety stirrup from an open configuration towards a closed configuration.

11 Claims, 3 Drawing Sheets

STIRRUP

FIELD OF INVENTION

The present invention relates to a stirrup used for mounting and riding an animal.

BACKGROUND TO THE INVENTION

A conventional stirrup comprises a flat platform for a rider's foot to rest on attached to an arc which extends from one end of the platform to the other end forming a loop. Further, the stirrup may provide a means for attaching the stirrup to the saddle. The conventional stirrup is attached to a saddle such that it is free to move relative to the saddle.

SUMMARY OF THE INVENTION

According to a first aspect of the invention, there is provided a stirrup comprising: a first portion adapted to rest against an animal to be ridden; a second portion adapted to support a rider's foot; and biasing means adapted to bias the safety stirrup from an open configuration, wherein the second portion is positioned so as to be suitable for supporting the rider's foot, towards a closed configuration, wherein the second portion is positioned so as to be unsuitable for supporting the rider's foot.

The second portion may be positioned to project outwardly from the animal to be ridden so as to be suitable for supporting the rider's foot in use. Also, in the closed configuration, the second portion may be positioned so as to be unsuitable for supporting the rider's foot and the extent by which the stirrup projects outwardly from the animal is reduced, such that, when a rider's foot is removed from the second portion, the second portion automatically moves to the closed configuration.

In use, the rider may exert a downward force on the second portion maintaining the stirrup in the open position, and when the rider ceases to exert a downward force on the second portion (due to falling from the animal for example), the safety stirrup may automatically close, due to the biasing means acting to move the stirrup from the open configuration to the closed configuration. Automatic return of the stirrup to the closed configuration in the absence of the rider may be advantageous in that the projection of the stirrup in a direction outward of the animal may be reduced, minimising the potential for injury to the rider which may occur, for example, in the instance that the animal moves erratically when the rider is mounting the animal, or in the instance that the rider falls from the animal. Put another way, a stirrup according to an embodiment of the invention may be adapted to automatically retract back to a flattened configuration to protect the rider and/or the animal from injury. An embodiment may therefore be referred to as a safety stirrup.

Further developments of the invention are the subject-matter of the dependent claims.

Embodiments may therefore provide a stirrup which is designed to rest against the side of an animal and provide an outwardly projecting platform only when a rider's foot is supported by the platform. When a rider's foot is not supported by the stirrup (e.g. removed from the platform), the platform is adapted to automatically retract towards the side of the animal so that the extent by which the stirrup projects outwardly from the animal is reduced. In other words, a stirrup according to an embodiment is adapted to automatically move from a first (open) configuration, wherein it has a first thickness or horizontal extent suitable for supporting the foot of a rider, to a second (closed) configuration, wherein it has a second thickness or horizontal extent not suitable for supporting the foot of a rider. The stirrup may be designed so that it is maintained in the first (open) configuration by the application of a force to the platform by the foot of a rider, wherein the applied force overcomes the force tending to move the stirrup to the second (closed) configuration.

According to an embodiment, when the stirrup is in the open position the first portion may be substantially parallel to the ground upon which the animal is supported (e.g. substantially horizontal).

According to an embodiment, when the stirrup is in the closed position the second portion may be parallel to, or in the same plane as the first portion.

The biasing means may comprise a coil spring. Such an embodiment may be considered as providing a spring-loaded stirrup, wherein a platform of the stirrup is adapted to automatically move to a closed configuration (wherein it is not arranged to support a rider's foot) by action of the spring when a holding force is not applied to the platform (by a rider's foot for example).

The second portion may further comprise a flange to assist the user in moving the safety stirrup from the closed position to the open position. This aids the user in exerting force on the second portion in order to change the position of the stirrup.

The stirrup may further comprise an attachment member for attaching the safety stirrup to horse tack. This may allow the user to attach the safety stirrup to an assembly of horse tack.

The stirrup may further comprise a strap attachment member for attaching the safety stirrup to a strap passing under the animal, so as to restrict movement of the safety stirrup in a direction away from the animal to be ridden. This may act to limit the freedom of the safety stirrup to move outward of the animal to be ridden, providing the advantage that the safety stirrup cannot swing away from the body of the animal which may result in injury of the user.

The second portion may be adapted to aid grip between the rider's foot and the surface of the second portion supporting the rider's foot. This may act to encourage adhesion between the rider's foot and the surface in contact with the rider's foot.

According to an embodiment of the invention, there is a stirrup substantially as herein described above with reference to the accompanying figures.

BRIEF DESCRIPTION OF THE DRAWINGS

An example of the invention will now be described with reference to the accompanying diagrams, in which.

DETAILED DESCRIPTION

Figure 1:
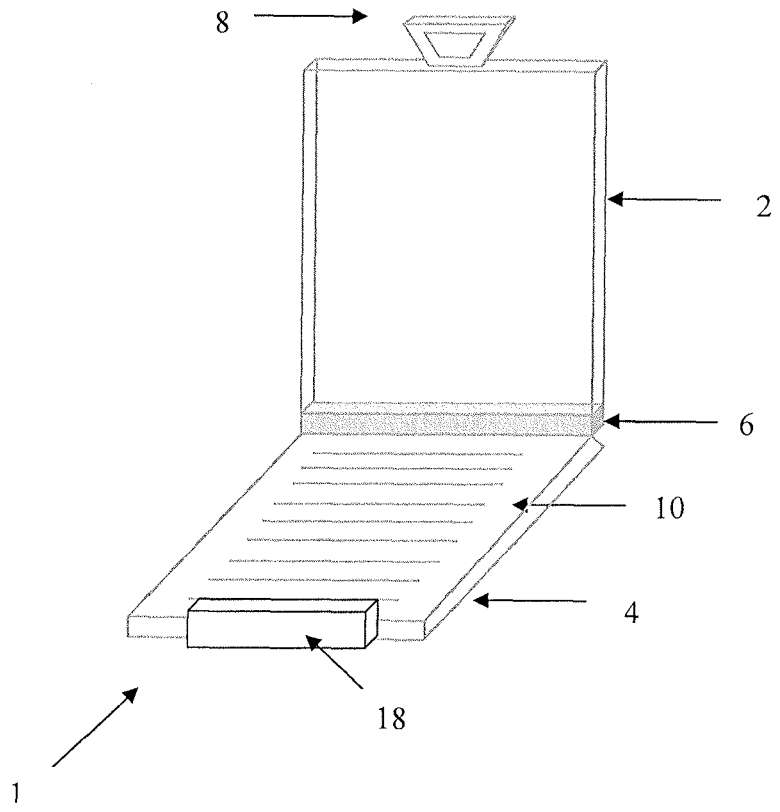
FIG. 1 is a perspective view of a stirrup according to the invention, wherein the safety stirrup is in an open position.

Referring to FIG. 1, there is shown a safety stirrup 1 according to the invention, wherein the safety stirrup is in an open position. The safety stirrup 1 comprises a first portion 2, and a second portion 4 positioned substantially perpendicular to the first portion 2, thereby defining an open position. In the open position, the second portion 4 is adapted to provide a platform for supporting a rider's foot.

A biasing member 6 acts to bias the second portion 4 towards a closed position (shown in FIG. 3), wherein, in the closed position, the angle between the first 2 and second 4 portions is such that the safety stirrup 1 is unsuitable for supporting a rider's foot.

The first portion 2 is provided with an attachment member 8 for incorporating the safety stirrup 1 into an assembly of horse tack 16. An inner surface 10 of the second portion 4 is adapted to provide grip between the rider's foot and the surface of the second portion 4 supporting the rider's foot. Also, a stopper flange 18 is provided at the distal end of the second portion 4 for preventing the rider's foot from sliding off the distal end of the second portion. The stopper flange 18 is therefore adapted to act as a foot stopper for restricting horizontal movement of the foot away from the first portion 2, thereby helping to prevent a rider's foot from slipping off the second portion 4.

Figure 2:
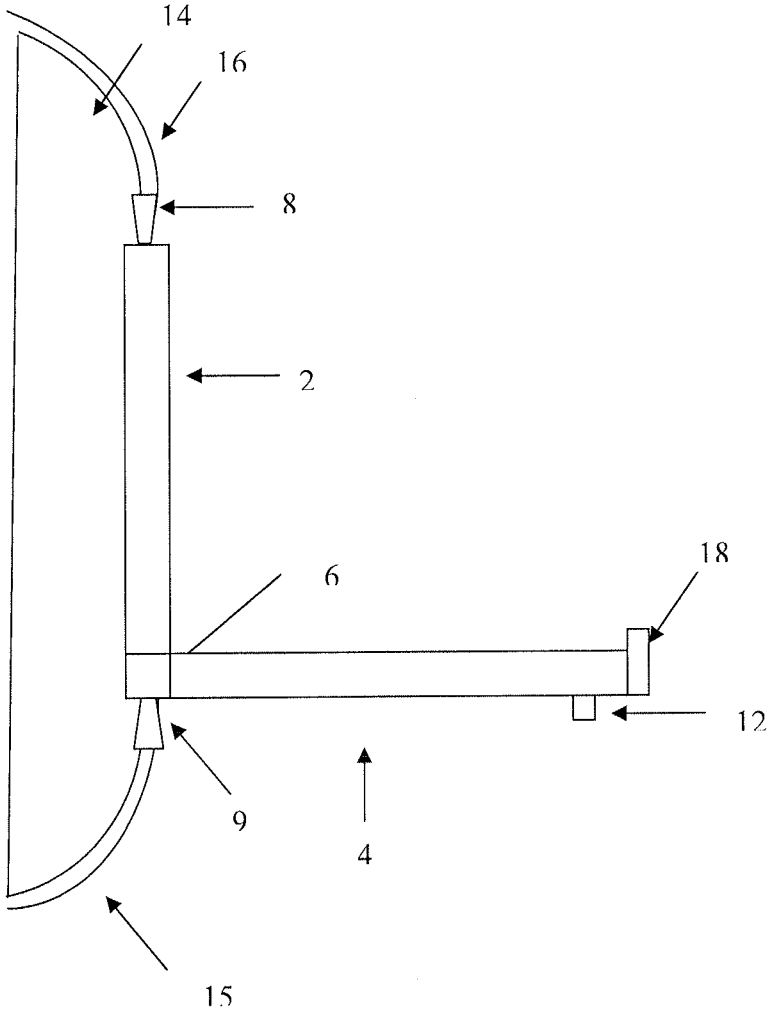
FIG. 2 is a side view of the stirrup of FIG. 1 in an open position.

In use, the safety stirrup 1 is added as a component of the horse tack 16 via the attachment member 8 as shown in FIG. 2. The strap attachment member 9 is used to attach the safety stirrup 1 to a strap 15 passing under the animal to be ridden. The flange 12 may be used to move the safety stirrup 1 from the closed position to the open position (by pulling the end of the second portion with the flange 12 away from the first portion 2). When the stirrup 1 is in the open position, the rider's foot is placed on the second portion 4 and applies a force downwardly onto the second portion so as to retain the stirrup in the open position.

The biasing member 6 biases the second portion 4 from the open position, wherein the second portion 4 is substantially perpendicular to the first portion 2, towards the closed position (shown in FIG. 3) such that, when the rider's foot is no longer exerting a downward force on the second portion 4, the second portion 4 moves towards the first portion 2. As such, when the rider ceases to exert force on the second portion 4 the safety stirrup 1 automatically closes. Thus, the rider's foot may be prevented from being caught in the stirrup. Further, automatic closure of the safety stirrup 1 decreases the extent by which the second portion 4 projects in a direction outward of the animal, thereby helping to reduce the risk of the stirrup hitting the rider and/or causing accidental injury.

Figure 3:
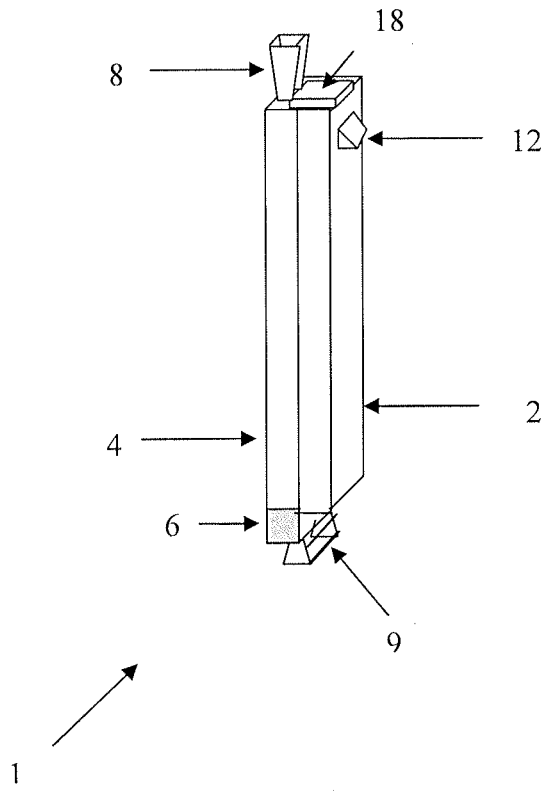
FIG. 3 shows the stirrup of FIG. 1 in a closed position.

FIG. 3 shows the safety stirrup in the closed position. In the closed position the angle between the first portion 2 and the second portion 4 is such that the position of the second portion 4 is not suitable for supporting the foot of the rider. Thus, it will be understood that, when in the closed position, the angle defined between the first and second portions may be in the range of zero (0) to sixty (60) degrees, preferably between zero (0) and thirty (30) degrees, more preferably less than ten (10) degrees, and even more preferable substantially zero (0) degrees. In other words, the safety stirrup may be adapted such that, when it is in the closed position, the first 2 and second 4 portions are substantially parallel or in the same plane (such that the angle between the first 2 and second 4 portions is zero degrees for example). In such an embodiment, the second portion 4 may be flush with the first portion 2 when in the closed position, and so the second portion 4 is provided with a flange 12 to aid the user in gripping the second portion 4 and moving the safety stirrup 1 from the closed position to the open position.

It will be appreciated that the first 2 and second 4 portions of the safety stirrup 1 are not limited to be rectangular in shape, for example they may be semi-circular. Further, the first portion 2 may be a different shape to the second portion 4.

Further, it will be appreciated that the embodiment described above has been explained in the context of animal having a substantially vertical side such that, in use, the first portion is substantially vertical and the second portion is biased from a horizontal position (in the open configuration) towards the vertical position (in the closed configuration).

Other embodiments may be adapted to be used against the side of an animal which is not vertical (but curved, for example). In such circumstances, the stirrup may be adapted such that the angle formed between the first and second portions when in the open configuration is greater than 90°. For example, for a situation where the stirrup will be positioned on the side of the animal such that, in use, the first portion rests at an angle of 30° from vertical, the second portion may be adapted to form an angle with the first portion of approximately 120° when in the open configuration so as to extend horizontally (and thus provide a horizontal support for a rider's foot). Embodiments may thus be designed so that the angle formed between the first and second portions when in the open configuration is adapted to cater for the riding application, rising style, and/or in-use position on the animal to be ridden and provide a substantially horizontal support surface for the rider's foot. The biasing means may thus be adapted to move the stirrup from an open configuration to a closed configuration by acting to reduce the angle formed between the first and second portions.

The invention claimed is:

1. A safety stirrup comprising:

a first portion adapted to rest against an animal to be ridden;

a second portion adapted to support a rider's foot in use; and biasing means adapted to bias the safety stirrup from an open configuration, wherein the second portion is positioned to project outwardly from the animal to be ridden so as to be suitable for supporting the rider's foot in use, towards a closed configuration, wherein the second portion is positioned so as to be unsuitable for supporting the rider's foot and an extent by which the stirrup projects outwardly from the animal is reduced, such that, when the rider's foot is removed from the second portion, the second portion automatically moves to the closed configuration;

wherein the first portion is adapted to lie flat against the animal in both the open configuration and the closed configuration in use, and wherein in the closed configuration, the second portion lies flush against the first portion.

2. The stirrup of claim 1, wherein, in use, when the safety stirrup is in the open configuration, the second portion is positioned so as to provide a support surface for the rider's foot, wherein the support surface has a longitudinal axis which is substantially horizontal.

3. The stirrup of claim 1, wherein when in the open configuration, an angle formed between the first and second portion is greater than sixty degrees.

4. The stirrup of claim 3, wherein when in the open configuration, an angle formed between the first and second portion is in a range of 90° to 120°.

5. The stirrup of claim 1, wherein when in the closed configuration the second portion is substantially parallel to, or substantially in the same plane, as the first portion.

6. The stirrup of claim 1, wherein the biasing means comprises a coil spring.

7. The stirrup of claim 1, wherein the second portion further comprises a flange to assist a user in moving the safety stirrup from the closed configuration to the open configuration.

8. The stirrup of claim 1 further comprising an attachment member for attaching the safety stirrup to horse tack.

9. The stirrup of claim 1 further comprising a strap attachment member for attaching the safety stirrup to a strap passing under the animal, so as to restrict movement of the safety stirrup in a direction away from the animal to be ridden.

10. The stirrup of claim 1, wherein the second portion is adapted to aid grip between the rider's foot and a surface of the second portion supporting the rider's foot.

11. A safety stirrup comprising:

a first portion adapted to rest against an animal to be ridden;

a second portion adapted to support a rider's foot; and biasing means adapted to bias the safety stirrup from an open configuration towards a closed configuration, wherein the biasing means is adapted to move the safety stirrup from the open configuration to the closed configuration by reducing an angle formed between the first and second portions, and wherein in the closed configuration, the second portion lies flush against the first portion.

* * * * *